US011098969B2

(12) United States Patent
DeJessa

(10) Patent No.: US 11,098,969 B2
(45) Date of Patent: Aug. 24, 2021

(54) BUTT PLATE RETENTION MECHANISM FOR AN AMMUNITION MAGAZINE

(71) Applicant: Smith & Wesson Inc., Springfield, MA (US)

(72) Inventor: Joseph DeJessa, West Brookfield, MA (US)

(73) Assignee: Smith & Wesson, Inc., Springfield, MA (US)

( * ) Notice: Subject to any disclaimer, the term of this patent is extended or adjusted under 35 U.S.C. 154(b) by 0 days.

(21) Appl. No.: 17/091,120

(22) Filed: Nov. 6, 2020

(65) Prior Publication Data

US 2021/0140730 A1 May 13, 2021

Related U.S. Application Data

(60) Provisional application No. 62/932,695, filed on Nov. 8, 2019.

(51) Int. Cl.
*F41A 9/71* (2006.01)
*F41A 9/70* (2006.01)

(52) U.S. Cl.
CPC ..... *F41A 9/70* (2013.01)

(58) Field of Classification Search
CPC ..... F41A 9/70; F41A 9/71
USPC ..... 42/49.02
See application file for complete search history.

(56) References Cited

U.S. PATENT DOCUMENTS

| | | | | |
|---|---|---|---|---|
| 8,925,231 | B2 | 1/2015 | Lee | |
| 9,784,513 | B2 | 10/2017 | Zimmer | |
| 10,126,076 | B2 | 11/2018 | Klein et al. | |
| 10,436,532 | B2 | 10/2019 | Walton | |
| 2016/0370138 | A1* | 12/2016 | Zamm | F41A 9/66 |
| 2019/0195584 | A1 | 6/2019 | Thomele et al. | |
| 2019/0285374 | A1 | 9/2019 | Bowler et al. | |

* cited by examiner

*Primary Examiner* — Reginald S Tillman, Jr.
(74) *Attorney, Agent, or Firm* — John A. Chionchio, Esq.; Ballard Spahr LLP

(57) ABSTRACT

A magazine for feeding ammunition to a firearm includes a tube surrounding a longitudinal axis and defining a central space for receiving the ammunition. The tube has first and second ends. A follower is slidably movable within the tube. A butt plate is removeably attached to the first end. The butt plate defines a bore. A plunger is movably positioned within the bore and includes a first mounting cam. A first catch, mounted on the butt plate, is engageable with the tube proximate to the first end. The first catch is movable relative to the butt plate in a direction transverse to the longitudinal axis. The first catch includes a cam follower engageable with the first cam. A spring acts between the plunger and the follower for biasing the plunger toward the butt plate and the follower toward the second end.

21 Claims, 6 Drawing Sheets

BUTT PLATE RETENTION MECHANISM FOR AN AMMUNITION MAGAZINE

CROSS REFERENCE TO RELATED APPLICATIONS

This application is based upon and claims benefit of priority to U.S. Provisional application No. 62/932,695, filed Nov. 8, 2019, which application is hereby incorporated by reference herein.

FIELD OF THE INVENTION

This invention relates to ammunition magazines for semiautomatic firearms.

BACKGROUND

Certain legal jurisdictions place limits on the capacity of magazines for semiautomatic firearms. As these jurisdictions are relatively few in number, and thus will generate a relatively small sales volume of reduced capacity magazines, it is advantageous to develop a reduced capacity magazine design which can be manufactured without the need for special tooling and the associated capital investment and expense over and above the expense and tooling needed for the manufacture of standard capacity magazines having a capacity determined by the design of the firearm and not by legislation.

SUMMARY

This invention concerns a magazine for feeding ammunition to a firearm. In an example embodiment, the magazine comprises a tube surrounding a longitudinal axis and defining a central space for receiving the ammunition. The tube has first and second ends oppositely disposed. A follower is slidably movable within the tube along the longitudinal axis. A butt plate is removeably attached to the first end of the tube. The butt plate defines a bore extending therethrough. A plunger is movably positioned within the bore of the butt plate. The plunger comprises a first cam mounted thereon. A first catch is mounted on the butt plate and is engageable with the tube proximate to the first end thereof. The first catch is movable relatively to the butt plate in a direction transverse to the longitudinal axis. The first catch comprises a first cam follower engageable with the first cam. A spring acts between the plunger and the follower for biasing the plunger toward the butt plate and the follower toward the second end of the tube. The first cam acts on the first cam follower to position the first catch into engagement with the tube upon motion of the plunger toward the butt plate, thereby retaining the butt plate to the tube. The first cam acts on the first cam follower to position the first catch out of engagement with the tube, thereby releasing the butt plate from the tube upon motion of the plunger toward the follower.

As an example, the bore is oriented parallel to the longitudinal axis of the tube.

In an example, the magazine further comprises a first slot located within the tube proximate to the first end thereof. The first catch comprises a first shoulder projecting transversely to the longitudinal axis. The first shoulder is engageable within the first slot upon the motion of the plunger toward the butt plate.

As an example, the first cam comprises a first trunnion projecting from the plunger. The first cam follower comprises a first track positioned within the first catch. The first cam is received within the first track.

In an example, the magazine further comprises a piston positioned within the tube between the spring and the butt plate. The piston is engageable with the plunger for transmitting a biasing force from the spring thereto. In a particular example, the piston comprises a panel and a boss. The panel is movable along the longitudinal axis within the tube. The boss projects from the panel into the bore for engagement with the plunger.

As an example, the butt plate comprises a lowermost surface. The longitudinal axis of the tube is oriented at an angle to the lowermost surface.

In an example, the magazine further comprises a second cam mounted on the plunger. A second catch is mounted on the butt plate and engageable with the tube proximate to the first end thereof. The second catch is movable relatively to the butt plate in a direction transverse to the longitudinal axis. The second catch comprises a second cam follower engageable with the second cam. The second cam acts on the second cam follower to position the second catch into engagement with the tube upon motion of the plunger toward the butt plate, thereby retaining the butt plate to the tube. The second cam acts on the second cam follower to position the second catch out of engagement with the tube, thereby releasing the butt plate from the tube upon motion of the plunger toward the follower. In a particular example, the second cam is mounted on an opposite side of the plunger from the first cam. In another particular example, the second catch is mounted on an opposite side of the plunger from the first catch.

As an example, the magazine further comprises a second slot located within the tube proximate to the first end thereof. The second catch comprises a second shoulder projecting transversely to the longitudinal axis. The second shoulder is engageable within the second slot upon the motion of the plunger toward the butt plate.

In an example, the second cam comprises a second trunnion projecting from the plunger. The second cam follower comprises a second track positioned within the second catch. The second cam is received within the second track.

This invention further concerns a magazine for feeding ammunition to a firearm. The magazine comprises a tube surrounding a longitudinal axis and defining a central space for receiving the ammunition. The tube has first and second ends oppositely disposed. A follower is slidably movable within the tube along the longitudinal axis. A butt plate is removeably attached to the first end of the tube. The butt plate defines a bore extending therethrough. A plunger is movably positioned within the bore of the butt plate. The plunger comprises a first cam mounted thereon. First and second catches are mounted on the butt plate and engageable with the tube proximate to the first end thereof. The first and second catches are movable relatively to the butt plate in opposite directions to one another transverse to the longitudinal axis. The first catch comprises a first cam follower engageable with the first cam and the second catch comprises a second cam follower engageable with the second cam. A spring acts between the plunger and the follower for biasing the plunger toward the butt plate and the follower toward the second end of the tube. The first and second cams act on the first and second cam followers respectively to position the first and second catches into engagement with the tube upon motion of the plunger toward the butt plate, thereby retaining the butt plate to the tube. The first and second cams act on the first and second cam followers respectively to position the first and second catches out of engagement with the tube, thereby releasing the butt plate from the tube upon motion of the plunger toward the follower.

In an example, wherein the bore is oriented parallel to the longitudinal axis of the tube.

As an example, the magazine further comprises first and second slots located within the tube proximate to the first end thereof. The first catch comprises a first shoulder projecting transversely to the longitudinal axis and the second catch comprises a second shoulder projecting transversely to the longitudinal axis. The first and second shoulders are respectively engageable within the first and second slots upon the motion of the plunger toward the butt plate.

In an example, the first cam comprises a first trunnion projecting from the plunger. The first cam follower comprises a first track positioned within the first catch. The first cam is received within the first track. The second cam comprises a second trunnion projecting from the plunger. The second cam follower comprises a second track positioned within the second catch. The second cam is received within the second track.

As an example, the magazine further comprises a piston positioned within the tube between the spring and the butt plate. The piston is engageable with the plunger for transmitting a biasing force from the spring thereto. In a particular example, the piston comprises a panel and a boss. The panel is movable along the longitudinal axis within the tube. The boss projects from the panel into the bore for engagement with the plunger.

In an example, the butt plate comprises a lowermost surface. The longitudinal axis of the tube is oriented at an angle to the lowermost surface. As an example, the second cam is mounted on an opposite side of the plunger from the first cam. In an example, the second catch is mounted on an opposite side of the plunger from the first catch.

DETAILED DESCRIPTION

Figure 1:
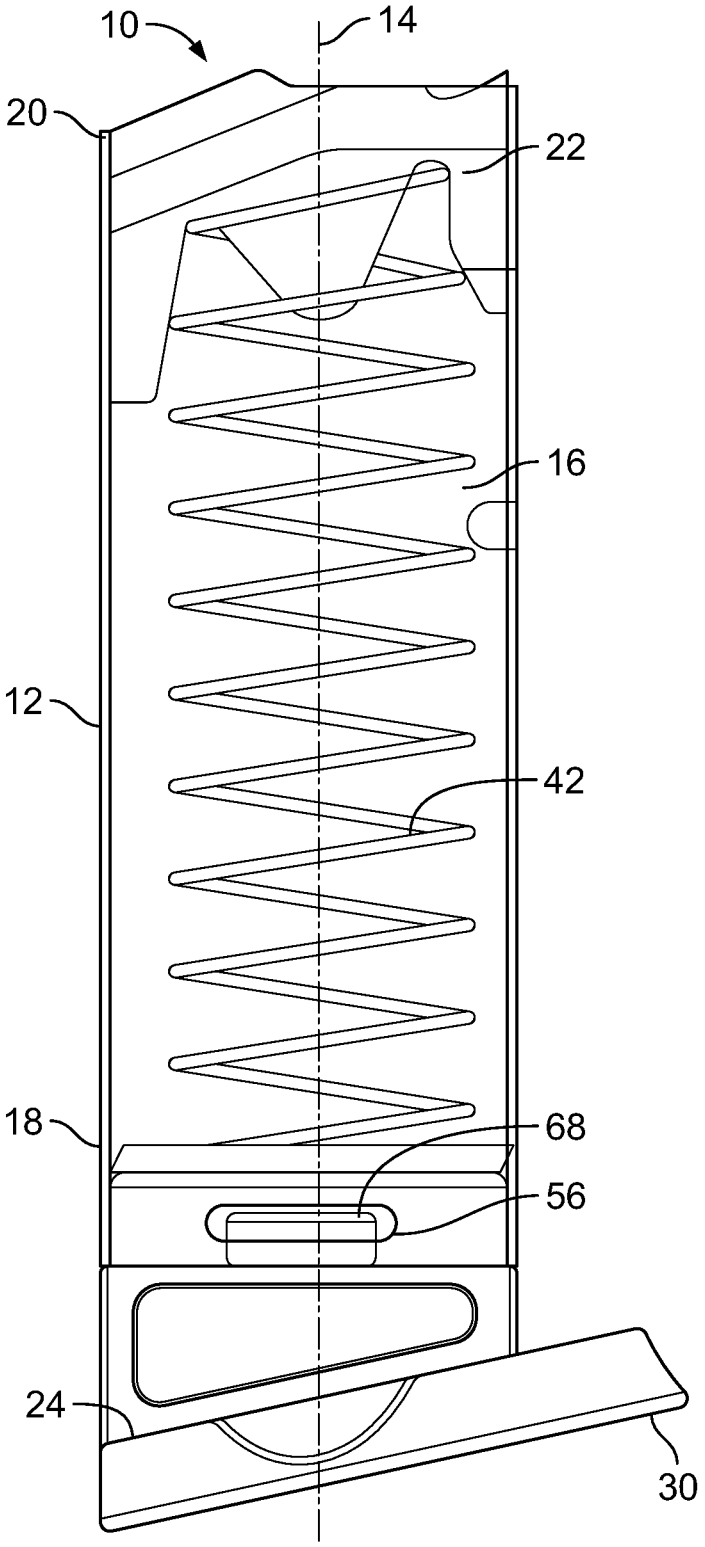
FIG. 1 is a side sectional view of an example embodiment of a magazine according to this invention.
Figure 2:
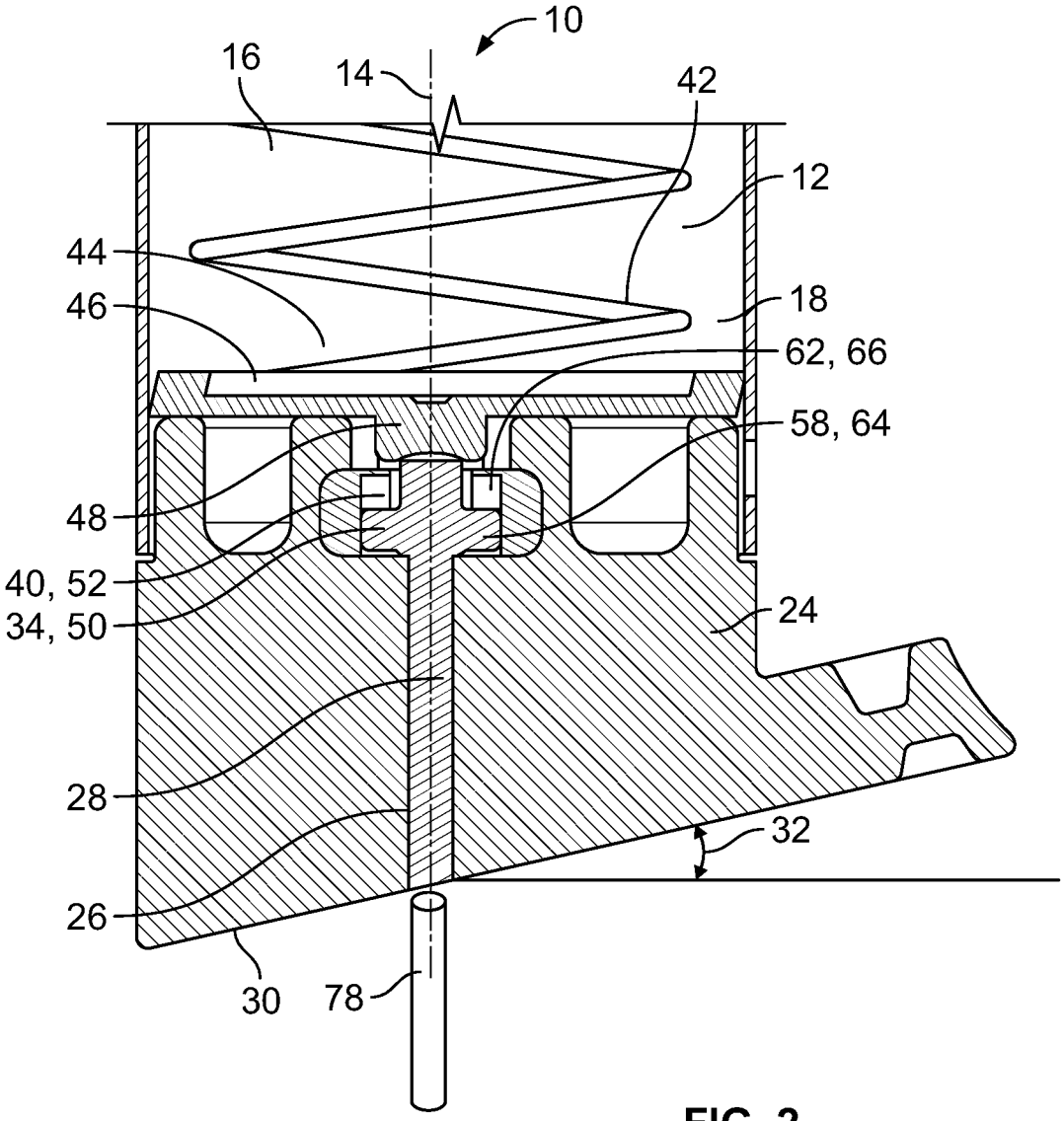
FIG. 2 is a side sectional view of an example retention mechanism according to this invention.

FIGS. 1 and 2 show an example ammunition magazine 10 according to this invention. The magazine 10 comprises a tube 12 surrounding a longitudinal axis 14 and defining a central space 16 for receiving ammunition. The tube 12 has respective first and second ends 18 and 20 oppositely disposed. As shown in FIG. 1, a follower 22 is slidably movable within the tube 12 along the longitudinal axis 14. A butt plate 24 is removeably attached to the first end 18 of the tube 12. As shown in FIG. 2, the butt plate 24 defines a bore 26 which extends through the butt plate 24. The bore 26 is oriented parallel to the longitudinal axis 14 of the tube 12. A plunger 28 is movably positioned within the bore 26. The butt plate 24 comprises a lowermost surface 30. The longitudinal axis 14 of the tube 12 may be oriented at an angle 32 to the lowermost surface 30 as in this example.

Figure 3:
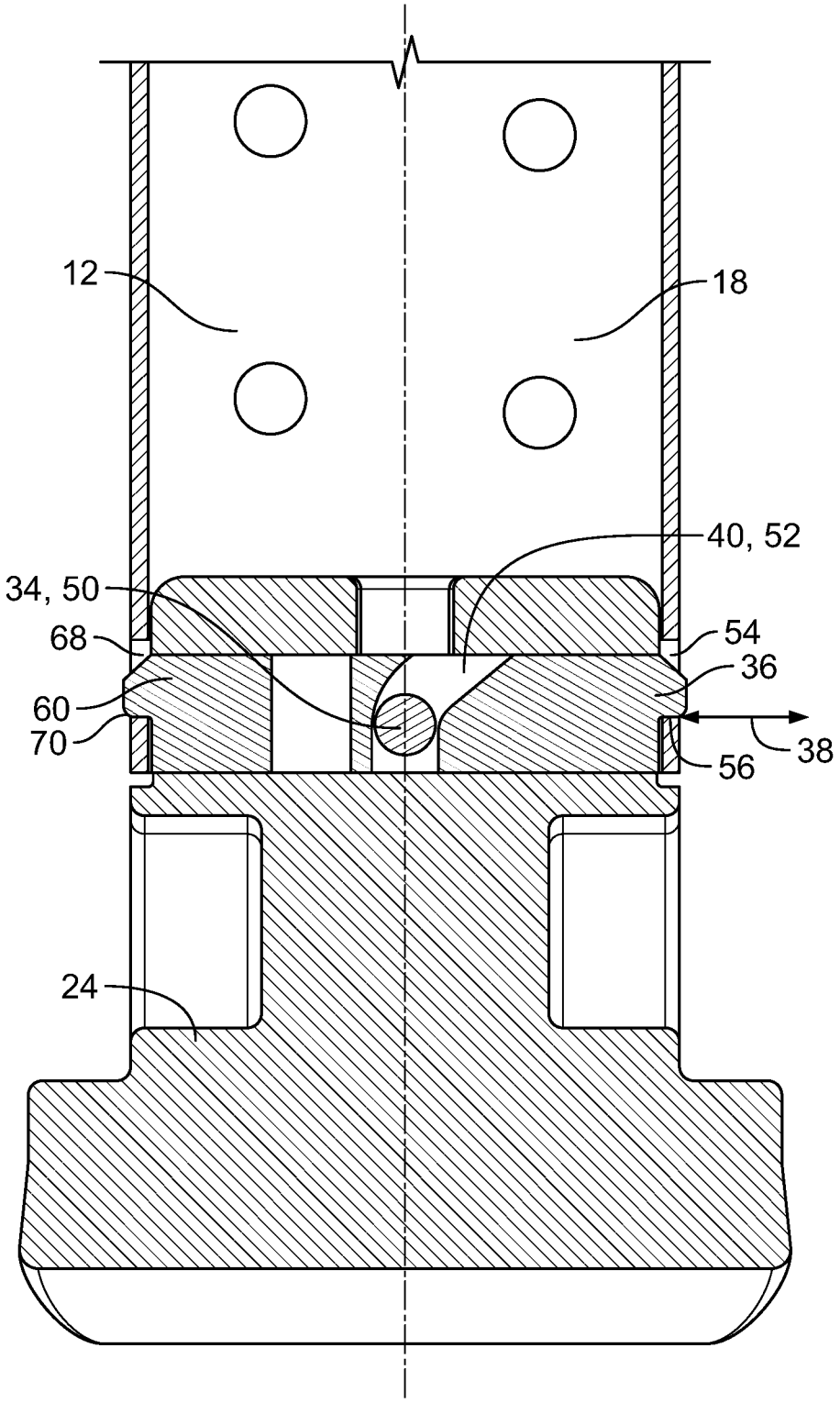
FIG. 3 is a rear sectional view of the example retention mechanism according to the invention
Figure 3A:
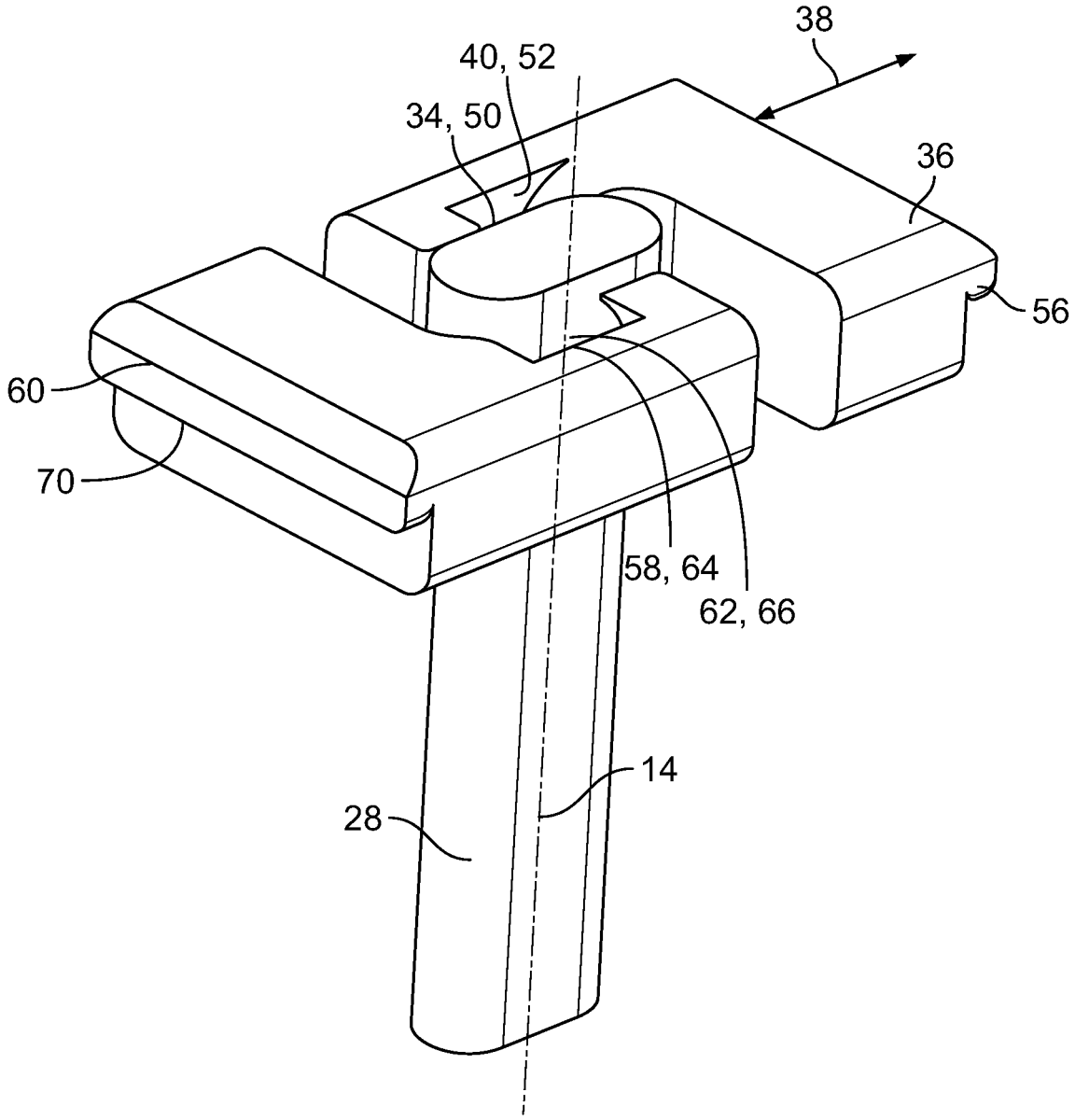
FIG. 3A is an isometric view of a portion of the example retention magazine according to the invention.
Figure 4:
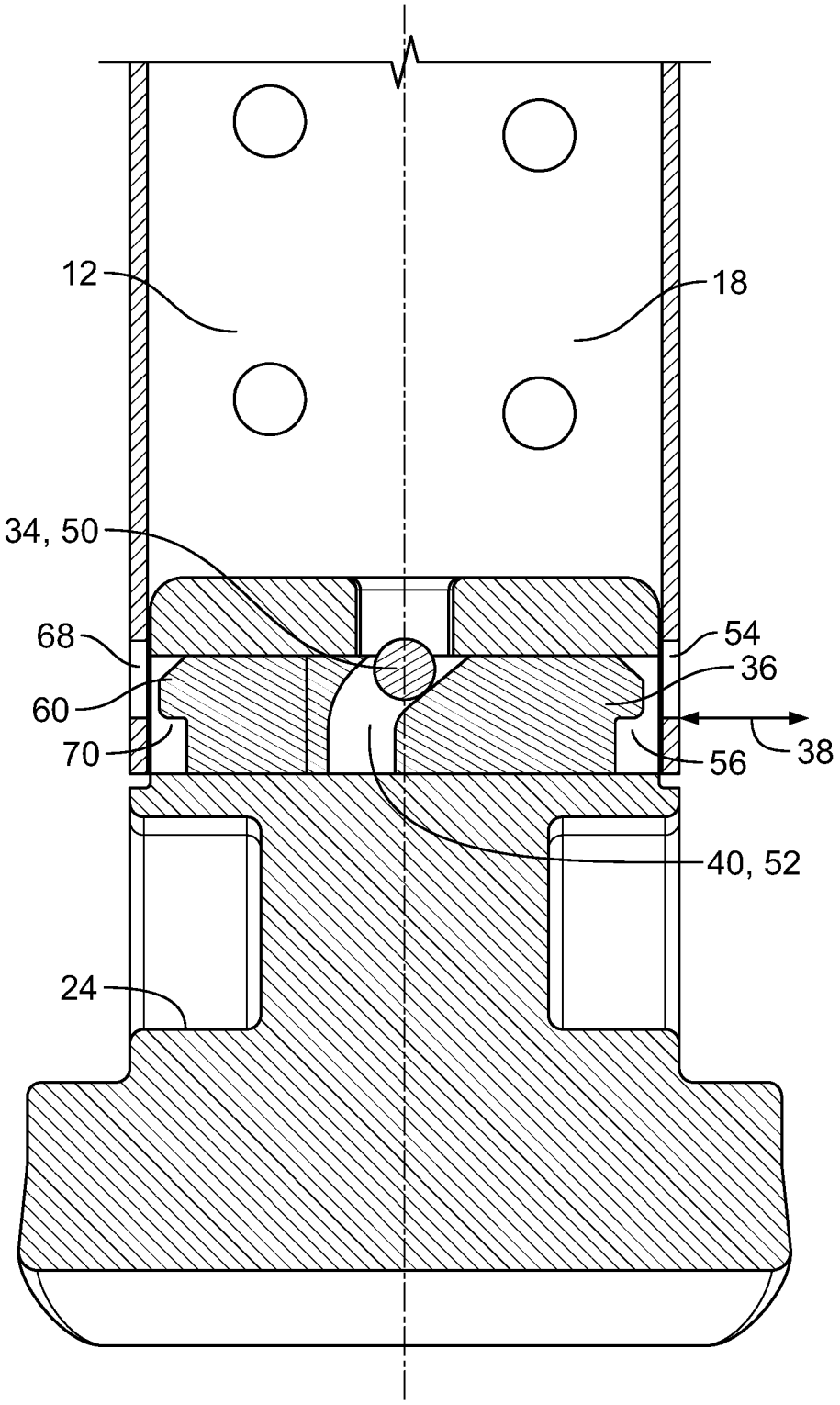
FIG. 4 is a rear sectional view of the example retention mechanism according to the invention.

As shown in FIGS. 2, 3 and 4, the plunger 28 comprises a first cam 34 mounted on the plunger. As shown in FIGS. 3 and 4, a first catch 36 is mounted on the butt plate 24 and is engageable with the tube 12 proximate to the first end 18. As shown in FIGS. 3, 3A, 4 and 4A, the first catch 36 is movable relatively to the butt plate 24 in a direction 38 transverse to the longitudinal axis 14. The first catch 36 comprises a first cam follower 40 engageable with the first cam 36.

As shown in FIGS. 1 and 2, a spring 42 acts between the plunger 28 and the follower 22 for biasing the plunger 28 toward the butt plate 24 and for biasing the follower 22 toward the second end 20 of the tube 12. As shown in FIG. 2, the magazine 10, comprises a piston 44 positioned within the tube 12 between the spring 42 and the butt plate 24. The piston 44 is engageable with the plunger 28 for transmitting a biasing force from the spring 42. The piston 44 comprises a panel 46 and a boss 48. The panel 46 is movable along the longitudinal axis 14 within the tube 12. The boss 48 projects from the panel 46 into the bore 26 for engagement with the plunger 28.

As shown in FIGS. 2, 3, 3A, and 4, the first cam 34 comprises a first trunnion 50 projecting from the plunger 28. The first cam follower 40 comprises a first track 52 positioned within the first catch 36. The first cam 34 is received within the first track 52.

As shown in FIGS. 3 and 4, the magazine 10 may further comprise a first slot 54 located within the tube 12 proximate to the first end 18. The first catch 36 comprises a first shoulder 56. The first shoulder 56 projects transversely to the longitudinal axis 14 and is engageable within the first slot 54 upon the motion of the plunger 28 toward the butt plate 24.

In use, as shown in FIG. 3, the first cam 34 acts on the first cam follower 40 to position the first catch 36 into engagement with the tube 12 upon motion of the plunger 28 toward the butt plate 24, along axis 14, thereby retaining the butt plate 24 to the tube 12. As shown in FIG. 4, the first cam 34 acts on the first cam follower 40 to position the first catch 36 out of engagement with the tube 12, thereby releasing the butt plate 24 from the tube 12 upon motion of the plunger 28 toward the follower 22 (FIG. 1) along axis 14.

Figure 4A:
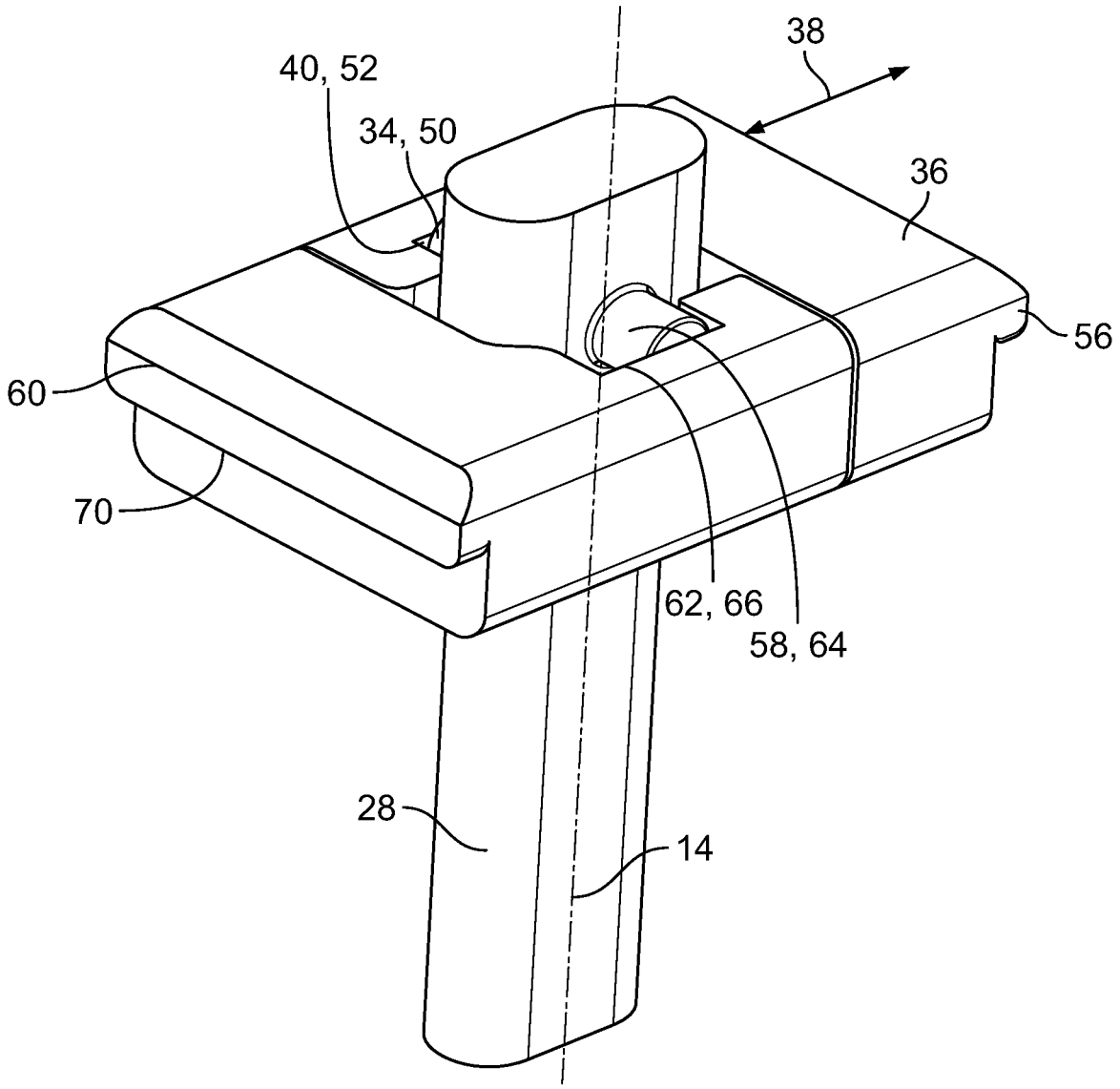
FIG. 4A is an isometric view of a portion of the example retention mechanism according to the invention.

As shown in FIGS. 2, 3A and 4A, the magazine 10 may also comprise a second cam 58 mounted on the opposite side of plunger 28 from the first cam 34. As shown in FIGS. 3A and 4A, a second catch 60 is mounted on the butt plate 24 and is engageable with the tube 12 proximate to the first end 18. The second catch 60 is mounted on an opposite side of the plunger 28 from the first catch 36 and is movable relatively to the butt plate 24 in a direction 34 transverse to the longitudinal axis 14. The second catch 60 comprises a second cam follower 62 engageable with the second cam 58.

As shown in FIGS. 2, 3A and 4A, the second cam 58 comprises a second trunnion 64 projecting from the plunger 28. The second cam follower 62 comprises a second track 66 positioned within the second catch 60. The second cam 58 is received within the second track 66.

As shown in FIGS. 1, 3 and 4, the magazine 10 may further comprises a second slot 68 located within the tube 12 proximate to the first end 18. As shown in FIGS. 3, 3A, 4 and 4A, the second catch 60 comprises a second shoulder 70 projecting transversely to the longitudinal axis 14. The second shoulder 70 is engageable within the second slot 68 upon the motion of the plunger 28 toward the butt plate 24.

In use, as shown in FIG. 3A, the second cam 58 acts on the second cam follower 62 to position the second catch 60 into engagement with the tube 12 upon motion of the plunger 28 toward the butt plate 24, thereby retaining the butt plate 24 to the tube 12. As shown in FIG. 4A, the second cam 58 acts on the second cam follower 62 to position the second catch 60 out of engagement with tube 12, thereby releasing butt plate 24 from the tube 12 upon the motion of the plunger 28 toward the follower 22.

As shown in FIG. 2, to change the tube 12 from a smaller to a larger capacity, a tool 78 would advantageously engage the plunger 28 local to the lowermost surface 30 of butt plate 24. Before tool 78 is used, the tube 12 is attached to butt plate 24 with the piston 44 engaging the plunger 28 and transmitting a biasing force from the spring 42. The biasing force is transmitted from the spring 24 through the panel 46 and boss 48 of the piston 44 to the plunger 28.

FIGS. 3 and 3A show the effect of biasing force acting on the plunger 28. The first and second cams 34 and 58 act on the first and second cam followers 40 and 62 respectively, positioning the first and second catches, 36 and 60, into engagement with the first and second slots, 54 and 68, located within the tube 12 proximate to the first end 18.

Referring to FIG. 2, to disengage butt plate 24 from tube 12, the tool 78 would urge the plunger 28 along axis 14 in a direction toward the tube 12. FIGS. 4 and 4A show the first and second cams 34 and 58 acting on the first and second cam followers 40 and 62 respectively positioning the first and second catches 36 and 60 out of engagement with the tube 12. With the first and second catches 36 and 40 out of engagement with the tube 12, the butt plate 24 may be disengaged from tube 12 and the tube may be changed.

The magazine 10 with the butt plate retention mechanism described herein is expected to provide a reduced capacity magazine design which can be manufactured without the need for special tooling and the associated capital investment and expense over and above the expense and tooling needed for the manufacture of standard capacity magazines having a capacity determined by the design of the firearm.

What is claimed is:

1. A magazine for feeding ammunition to a firearm, said magazine comprising:

a tube surrounding a longitudinal axis and defining a central space for receiving said ammunition, said tube having first and second ends oppositely disposed;

a follower slidably movable within said tube along said longitudinal axis;

a butt plate removeably attached to said first end of said tube, said butt plate defining a bore extending therethrough;

a plunger movably positioned within said bore of said butt plate, said plunger comprising a first cam mounted thereon;

a first catch mounted on said butt plate and engageable with said tube proximate to said first end thereof, said first catch being movable relatively to said butt plate in a direction transverse to said longitudinal axis, said first catch comprising a first cam follower engageable with said first cam;

a spring acting between said plunger and said follower for biasing said plunger toward said butt plate and said follower toward said second end of said tube; wherein said first cam acts on said first cam follower to position said first catch into engagement with said tube upon motion of said plunger toward said butt plate, thereby retaining said butt plate to said tube, and, said first cam acts on said first cam follower to position said first catch out of engagement with said tube, thereby releasing said butt plate from said tube upon motion of said plunger toward said follower.

2. The magazine according to claim 1, wherein said bore is oriented parallel to said longitudinal axis of said tube.

3. The magazine according to claim 1, further comprising:

a first slot located within said tube proximate to said first end thereof; and wherein said first catch comprises a first shoulder projecting transversely to said longitudinal axis, said first shoulder being engageable within said first slot upon said motion of said plunger toward said butt plate.

4. The magazine according to claim 1, wherein:

said first cam comprises a first trunnion projecting from said plunger;

said first cam follower comprises a first track positioned within said first catch, said first cam being received within said first track.

5. The magazine according to claim 1, further comprising a piston positioned within said tube between said spring and said butt plate, said piston being engageable with said plunger for transmitting a biasing force from said spring thereto.

6. The magazine according to claim 5, wherein said piston comprises:

a panel movable along said longitudinal axis within said tube;

a boss projecting from said panel into said bore for engagement with said plunger.

7. The magazine according to claim 1, wherein said butt plate comprises a lowermost surface, said longitudinal axis of said tube being oriented at an angle to said lowermost surface.

8. The magazine according to claim 1, further comprising:

a second cam mounted on said plunger;

a second catch mounted on said butt plate and engageable with said tube proximate to said first end thereof, said second catch being movable relatively to said butt plate in a direction transverse to said longitudinal axis, said second catch comprising a second cam follower engageable with said second cam; wherein said second cam acts on said second cam follower to position said second catch into engagement with said tube upon motion of said plunger toward said butt plate, thereby retaining said butt plate to said tube, said second cam acting on said second cam follower to position said second catch out of engagement with said tube, thereby releasing said butt plate from said tube upon motion of said plunger toward said follower.

9. The magazine according to claim 8, wherein said second cam is mounted on an opposite side of said plunger from said first cam.

10. The magazine according to claim 8, wherein said second catch is mounted on an opposite side of said plunger from said first catch.

11. The magazine according to claim 8, further comprising:

a second slot located within said tube proximate to said first end thereof; and wherein said second catch comprises a second shoulder projecting transversely to said longitudinal axis, said second shoulder being engageable within said second slot upon said motion of said plunger toward said butt plate.

12. The magazine according to claim 8, wherein:

said second cam comprises a second trunnion projecting from said plunger;

said second cam follower comprises a second track positioned within said second catch, said second cam being received within said second track.

13. A magazine for feeding ammunition to a firearm, said magazine comprising:

a tube surrounding a longitudinal axis and defining a central space for receiving said ammunition, said tube having first and second ends oppositely disposed;

a follower slidably movable within said tube along said longitudinal axis;

a butt plate removeably attached to said first end of said tube, said butt plate defining a bore extending therethrough;

a plunger movably positioned within said bore of said butt plate, said plunger comprising a first cam mounted thereon;

first and second catches mounted on said butt plate and engageable with said tube proximate to said first end thereof, said first and second catches being movable relatively to said butt plate in opposite directions to one another transverse to said longitudinal axis, said first catch comprising a first cam follower engageable with said first cam, said second catch comprising a second cam follower engageable with said second cam;

a spring acting between said plunger and said follower for biasing said plunger toward said butt plate and said follower toward said second end of said tube; wherein said first and second cams act on said first and second cam followers respectively to position said first and second catches into engagement with said tube upon motion of said plunger toward said butt plate, thereby retaining said butt plate to said tube, and, said first and second cams act on said first and second cam followers respectively to position said first and second catches out of engagement with said tube, thereby releasing said butt plate from said tube upon motion of said plunger toward said follower.

14. The magazine according to claim 13, wherein said bore is oriented parallel to said longitudinal axis of said tube.

15. The magazine according to claim 14, further comprising:

first and second slots located within said tube proximate to said first end thereof; and wherein said first catch comprises a first shoulder projecting transversely to said longitudinal axis, said second catch comprises a second shoulder projecting transversely to said longitudinal axis, said first and second shoulders being respectively engageable within said first and second slots upon said motion of said plunger toward said butt plate.

16. The magazine according to claim 14, wherein:

said first cam comprises a first trunnion projecting from said plunger;

said first cam follower comprises a first track positioned within said first catch, said first cam being received within said first track;

said second cam comprises a second trunnion projecting from said plunger;

said second cam follower comprises a second track positioned within said second catch, said second cam being received within said second track.

17. The magazine according to claim 13, further comprising a piston positioned within said tube between said spring and said butt plate, said piston being engageable with said plunger for transmitting a biasing force from said spring thereto.

18. The magazine according to claim 17, wherein said piston comprises:

a panel movable along said longitudinal axis within said tube;

a boss projecting from said panel into said bore for engagement with said plunger.

19. The magazine according to claim 13, wherein said butt plate comprises a lowermost surface, said longitudinal axis of said tube being oriented at an angle to said lowermost surface.

20. The magazine according to claim 13, wherein said second cam is mounted on an opposite side of said plunger from said first cam.

21. The magazine according to claim 13, wherein said second catch is mounted on an opposite side of said plunger from said first catch.

* * * * *